US010074229B2

(12) United States Patent
Lee

(10) Patent No.: US 10,074,229 B2
(45) Date of Patent: Sep. 11, 2018

(54) MEDIUM STORAGE BOX AND FINANCIAL DEVICE

(71) Applicant: LG CNS CO., LTD., Seoul (KR)

(72) Inventor: Sungwoo Lee, Seoul (KR)

(73) Assignee: LG CNS CO., LTD, Seoul (KR)

( * ) Notice: Subject to any disclaimer, the term of this patent is extended or adjusted under 35 U.S.C. 154(b) by 7 days.

(21) Appl. No.: 15/298,031

(22) Filed: Oct. 19, 2016

(65) Prior Publication Data

US 2017/0109958 A1 Apr. 20, 2017

(30) Foreign Application Priority Data

Oct. 19, 2015 (KR) ..... 10-2015-0145157

(51) Int. Cl.

| | |
|---|---|
| ***B65H 3/44*** | (2006.01) |
| ***G07D 11/00*** | (2006.01) |
| ***B65H 3/06*** | (2006.01) |
| *B65H 7/00* | (2006.01) |
| *B65H 43/00* | (2006.01) |

(52) U.S. Cl.

CPC ..... *G07D 11/0012* (2013.01); *B65H 3/06* (2013.01); *B65H 3/0684* (2013.01); *B65H 7/00* (2013.01); *B65H 43/00* (2013.01)

(58) Field of Classification Search

CPC ..... B65H 2405/332; B65H 7/00; B65H 43/00

See application file for complete search history.

(56) References Cited

U.S. PATENT DOCUMENTS

| | | | | |
|---|---|---|---|---|
| 9,346,639 | B2 | 5/2016 | Kim | |
| 2001/0015309 | A1 | 8/2001 | Ikuta | |
| 2010/0218707 | A1 | 9/2010 | Billet et al. | |
| 2012/0032391 | A1 | 2/2012 | Holland-Letz et al. | |
| 2013/0140756 | A1 | 6/2013 | Kim | |
| 2014/0318925 | A1* | 10/2014 | Lee | G07F 19/202 194/206 |

FOREIGN PATENT DOCUMENTS

| | | | |
|---|---|---|---|
| EP | 1130551 | A2 | 9/2001 |
| EP | 2600322 | A1 | 6/2013 |
| JP | 2006038914 | A | 2/2006 |
| JP | 2013117963 | A | 6/2013 |
| JP | 2015-014968 | A | 1/2015 |
| KR | 10-2014-0002185 | A | 1/2014 |
| WO | 2009047743 | A2 | 4/2009 |

* cited by examiner

*Primary Examiner* — Howard J Sanders
(74) *Attorney, Agent, or Firm* — Dentons US LLP

(57) ABSTRACT

The present disclosure relates to a medium storage box and a financial device. A medium storage box according to an aspect comprises a case; a plurality of storage units which is provided in an inner space of the case; a plurality of medium separating and stacking devices which are disposed on each of the plurality of storage units and separate stacked media or transfer and stack media to each of storage units; an inner transport unit which is used for transferring a medium to the plurality of medium separating and stacking devices in the case; and a driving unit which transfers power to the plurality of medium separating and stacking devices and the inner transport unit.

14 Claims, 6 Drawing Sheets

MEDIUM STORAGE BOX AND FINANCIAL DEVICE

CROSS-REFERENCE TO RELATED APPLICATIONS

This present application claims priority under 35 U.S.C. § 119 and 35 U.S.C. § 365 to Korean Application No. 10-2015-0145157 (filed on Oct. 19, 2015), which is hereby incorporated by reference in its entirety.

BACKGROUND

The present disclosure relates to a medium storage box and a financial device.

In general, financial devices are devices for processing financial business desired by customers comprising depositing or withdrawing media such as bills and checks. For example, the bills, the checks, and the like may be called "media".

A medium storage box for storing a medium is disclosed in the Korean Patent Publication No. 1250693 which is the related art.

The medium storage box comprises a medium processing device which is used for depositing a medium in an inside thereof and withdrawing a medium to the outside thereof, a medium stacking unit which is a space in which a medium is stacked, and a path which is a space in which a medium is moved.

In general, such a medium storage box is separately provided according to a type of a medium for business efficiency. As an example, the medium storage box may include a check storage box and a cash storage box. In a case of the cash storage box, the cash storage box may be classified again according to each type of cash.

However, when considering a limiting space of inside of the financial devices, there is a problem of space utilization being reduced in a case where the medium storage box is separately provided according to each type of a medium. Further, there is a problem of an appearance of the financial device being expanded according to the number of the medium storage box.

In order to solve the problems, it is considered that a plurality of spaces in which different kinds of media are stacked are formed by dividing an inside of single medium storage box into each space.

However, even in this case, there is also a problem of the number of the component thereof being increased and according to this the manufacturing cost being increased since the medium processing device which is used for processing a medium per each space is provided.

SUMMARY

An objective of the present disclosure is to provide a medium storage box in which a plurality of storage units are formed and a financial device having the same.

A medium storage box according to an aspect comprises a case; a plurality of storage units which is provided in an inner space of the case; a plurality of medium separating and stacking devices which are disposed on each of the plurality of storage units and separate the stacked medium or transfer and stack media to each of storage units; an inner transport unit to transfer media to the plurality of medium separating and stacking devices in the case; and a driving unit which transfers power to the plurality of medium separating and stacking devices and the inner transport unit.

A medium storage box according to another aspect comprises a case; a plurality of storage units which is provided in an inner space of the case; a plurality of medium separating and stacking devices which include a feed roller, a pickup roller, a gate roller and a sheet roller coaxially positioning with the gate roller; an inner transport unit to transfer media to the plurality of medium separating and stacking devices in the case; a driving unit to drive the plurality of medium separating and stacking devices; and a rotating control unit to control a rotation angle of the sheet roller.

A financial device according to another aspect comprises a customer information obtaining unit that obtains customer information; a user interface unit that displays a menu and information for deposits or withdrawals and is input or selected a command or information for deposits or withdrawals; and a medium storage box which stores media for depositing or withdrawing by a customer. The medium storage box comprises a case; a plurality of storage units which are provided in an inner space of the case; a plurality of medium separating and stacking devices which are disposed on each of the plurality of storage units and separate the stacked media or transfer and stack media to each of storage units; an inner transport path which is used for transferring media to the plurality of medium separating and stacking devices in the case; and a driving unit which transfers power to the plurality of medium separating and stacking devices and the inner transport unit.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments of the present disclosure is a device that performs financial businesses, as an example, medium processing comprising processing such as deposit processing, giro receipt, gift certificate exchange, or the like and/or processing such as withdrawal processing, giro dispensing, gift certificate dispensing, or the like by receiving various media such as, bills, stocks (comprising checks), giros, coins, gift certificates, or the like. For example, the financial device may comprise an automatic teller machine (ATM) such as a cash dispenser (CD) and a cash recycling device. However, the financial device is not limited to the above-described examples. For example, the financial device may be a device for automatically performing the financial businesses such as a financial information system (FIS).

Hereinafter, assuming that the financial device is the ATM, an embodiment of the present disclosure will be described. However, this assumption is merely for convenience of description, and technical idea of the present disclosure is not limited to the ATM.

Figure 1:
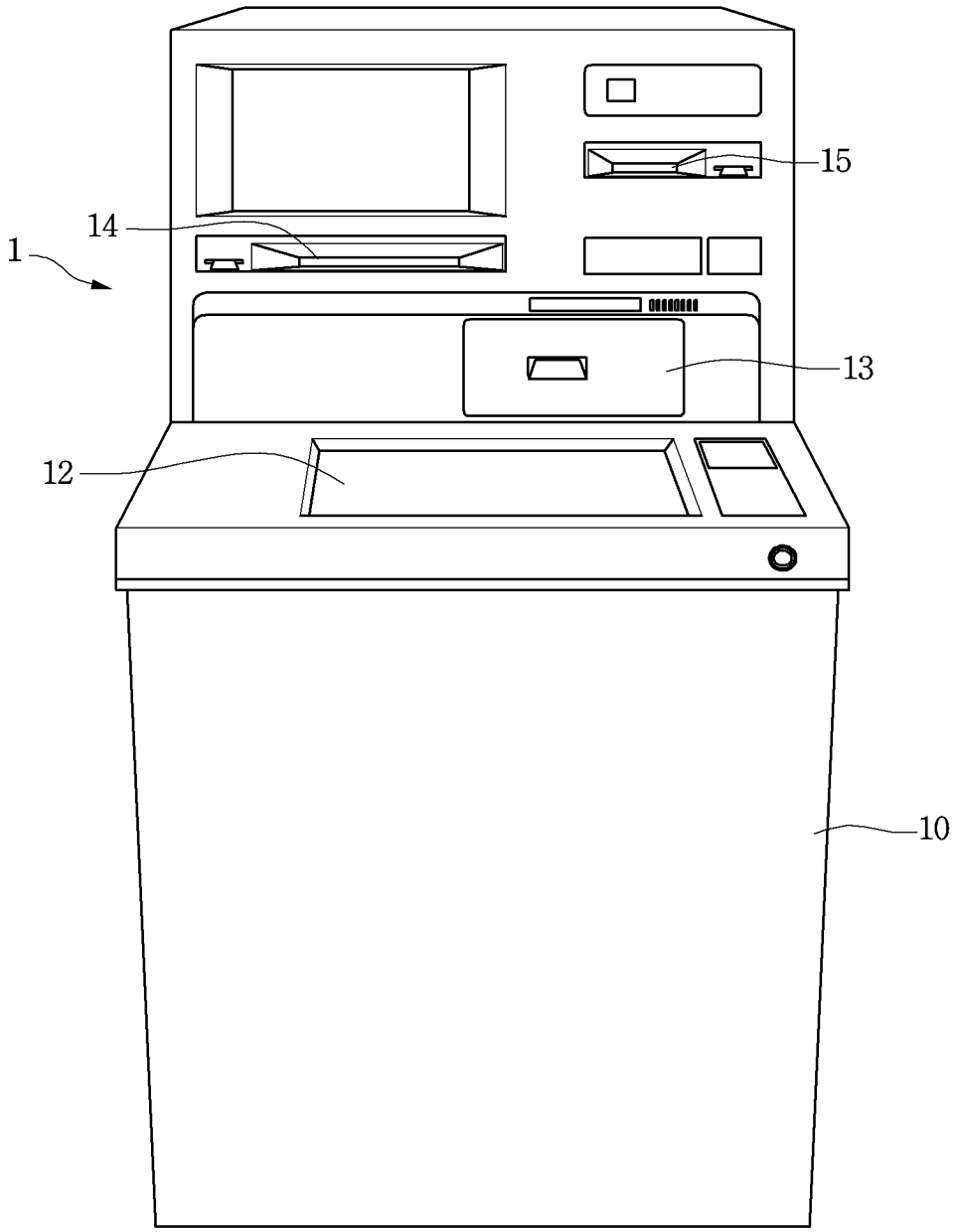
FIG. 1 is a perspective view illustrating a financial device according to an embodiment of the present disclosure.

FIG. 1 is a perspective view illustrating a financial device according to an embodiment of the present disclosure.

With reference to FIG. 1, a financial device 1 according to an embodiment may comprise a main body 10 built in a plurality of a components in the inside thereof. The main body 10 may comprise a medium depositing and withdrawing unit 13 for depositing and withdrawing a medium.

The medium depositing and withdrawing unit 13 comprises a medium accommodation space accessible by a customer. The accommodation space may be opened and closed by the shielding member such as a shutter or a cover and may be sometimes maintained in an opened state without being opened and closed.

The medium depositing and withdrawing unit 13 may play a role of a common depositing and withdrawing unit that can be deposited and withdrawn various kinds of media. Media by the bundle unit comprising a single sheet can be input to the medium depositing and withdrawing unit 13. Media by the bundle unit can be output to the medium depositing and withdrawing unit 13.

In addition, the financial device 1 may comprise a bankbook depositing and withdrawing unit 14 for depositing and withdrawing the bankbook and a card depositing and withdrawing unit 15 for depositing and withdrawing a card according to the kind of the financial device 1. The bankbook depositing and withdrawing unit 14 or the card depositing and withdrawing unit 15 according to the present disclosure is referred to as a customer information obtaining portion for obtaining information of the customer. Type of the customer information obtaining portion according to the present disclosure has no restriction, it is possible to obtain information stored in a RFID tag or USB or to obtain customer information using biometric information such as fingerprints.

In addition, the financial device 1 may further include a user interface unit 12 that displays a menu and information for deposits or withdrawals and is input or selected a command or information for deposits or withdrawals.

Figure 2:
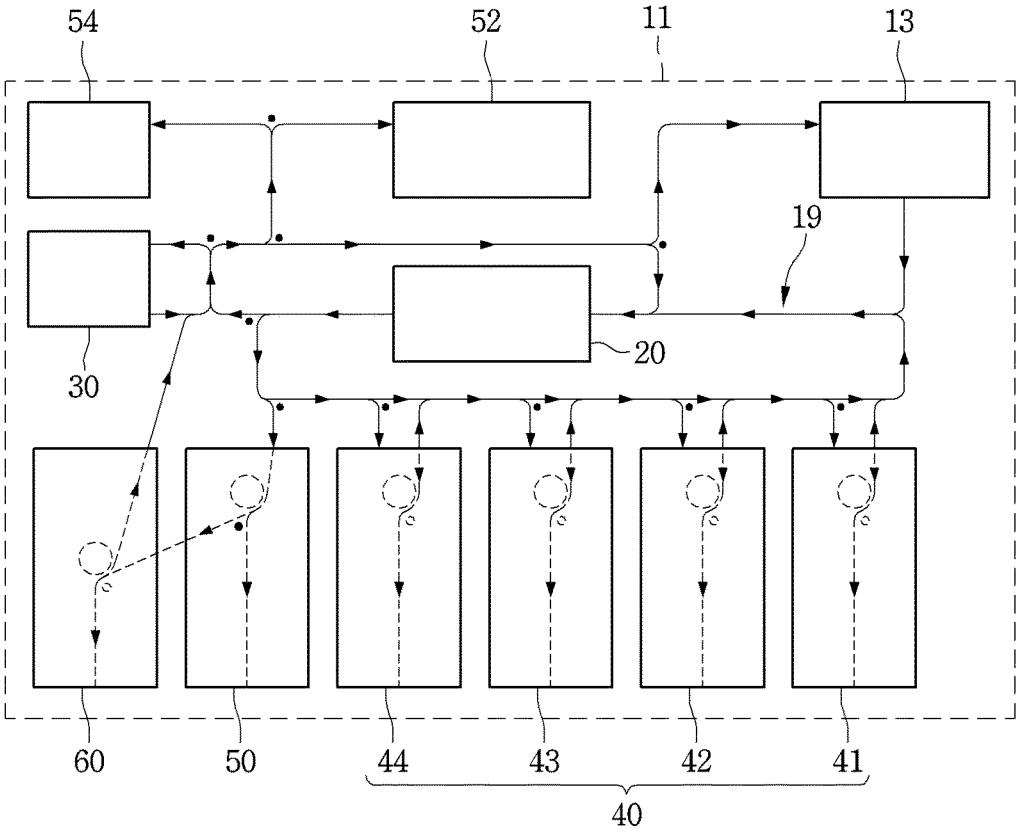
FIG. 2 is a configuration view illustrating a medium processing device according to the embodiment of the present disclosure.

FIG. 2 is a configuration view illustrating a medium processing device according to the embodiment of the present disclosure.

With reference to FIG. 2, the financial device 1 may comprise a medium processing device 11. The medium processing device 11 may be included the medium depositing and withdrawing unit 13.

The medium processing device 11 may comprise a discrimination unit 20. The discrimination unit 20 is capable of discriminating the kind of a medium or determining an abnormal medium when the medium is deposited or withdrawn.

The medium processing apparatus 11 may further comprise a temporary stacking unit 30 for temporarily stacking a medium. The temporary stacking unit 30 temporarily stores the medium that is accommodated through the medium depositing and withdrawing unit 13 in a case where the customer wants to deposit a medium to the financial device 1. The medium stacked into the temporary stacking unit 30 is transferred to the medium storage box 40 to be described below when the customer finally determines the medium accommodation. Alternatively, the temporary stacking unit 30 is capable of temporarily stacking the medium to be withdrawn to the medium depositing and withdrawing unit.

The medium processing device 11 may further abnormal medium a medium storage box 40 for storing a medium. The medium storage box 40 may abnormal medium at least one bill storage boxes 41, 42, and 43 and at least one check storage box 44. In the present specification, there is no limit of the number of the bill storage boxes 41, 42 and 43 and check storage box 44. As another example, the medium storage box 40 may abnormal medium only the bill storage box or the check storage box.

A medium inlet for depositing the transferred medium and a medium outlet for withdrawing a medium that is stacked in the inside of the medium storage box to the outside is formed in the medium storage box 40. In general, the medium inlet and the medium outlet may be formed on the upper end of the box that forms the appearance of the medium storage box 40.

In addition, a medium separation means in which a medium transferred from the outside of the medium storage box 40 is stacked side by side and which separates the stacked media one by one to transfer the separated media into the outside of the medium storage box 40 is provided in the inside of the medium storage box 40. In other words, media stored in the medium storage box 40 may be withdrawn to the outside and the deposited medium may be stored in the medium storage box 40.

The medium processing device 11 may further comprise a first collecting box 50 in which a medium determined as an abnormal medium in the depositing process is stored, a second collecting box 52 in which a medium determined as an abnormal medium in the withdrawing process is stored, and a collecting supplement box 60.

The collecting supplement box 60 may supplement a medium to the medium storage box 40 or may collect a medium from the medium storage box 40. Further, the financial device 1 may further comprise a third collecting box 54 in which non-received media are collected in a case where a customer does not receive a medium that is discharged to the medium depositing and withdrawing unit 13 for withdrawal.

Each module (the medium depositing and withdrawing unit, the discrimination unit, the medium storage box, the temporary stacking unit, the collecting box, or the like) that constitutes the financial device in the present disclosure is connected by means of a transferring path 19.

Figure 3:
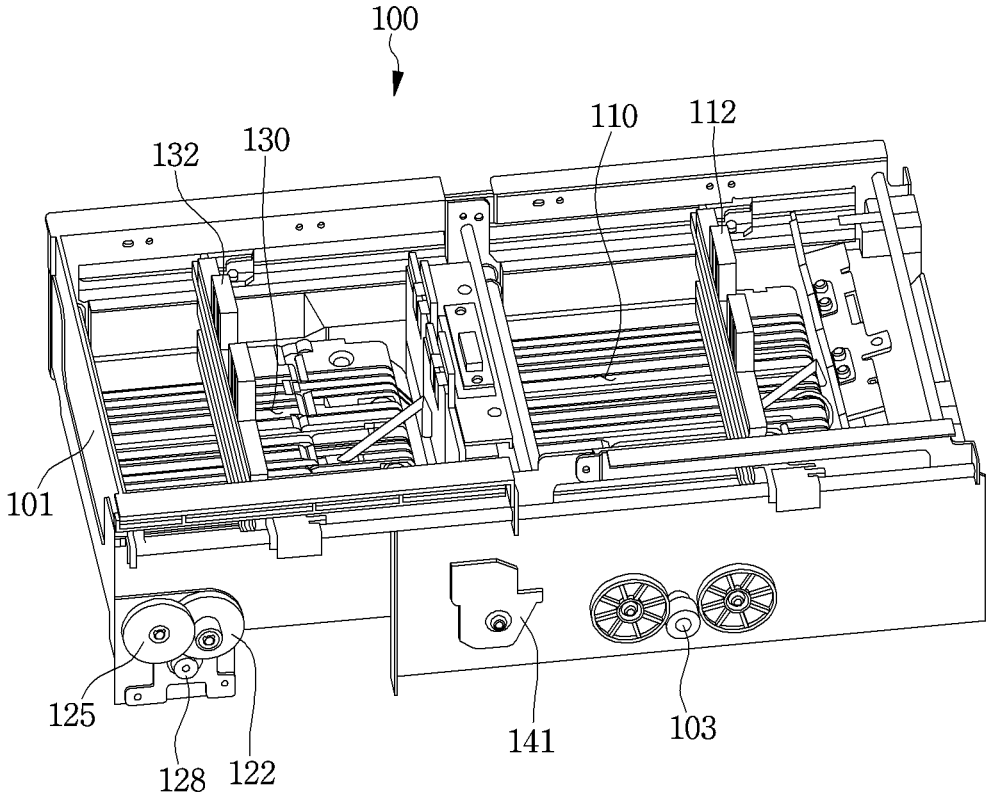
FIG. 3 is a perspective view illustrating a medium storage box according to the embodiment of the present disclosure.
Figure 4:
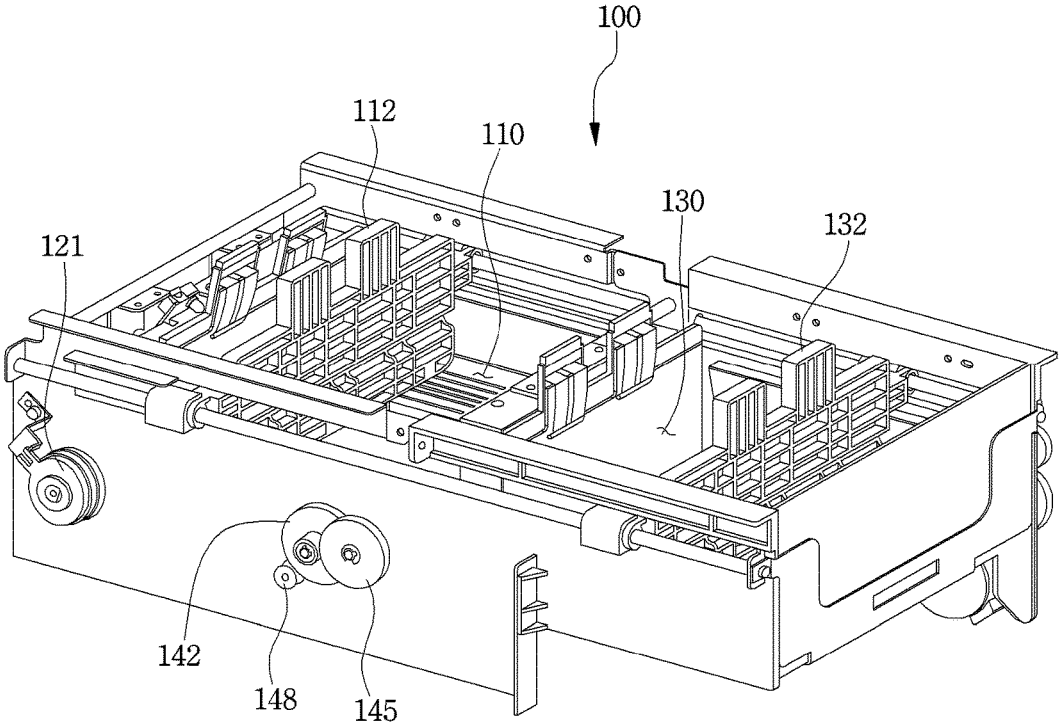
FIG. 4 is a perspective view illustrating the medium storage box in FIG. 3 viewed at another angle.
Figure 5:
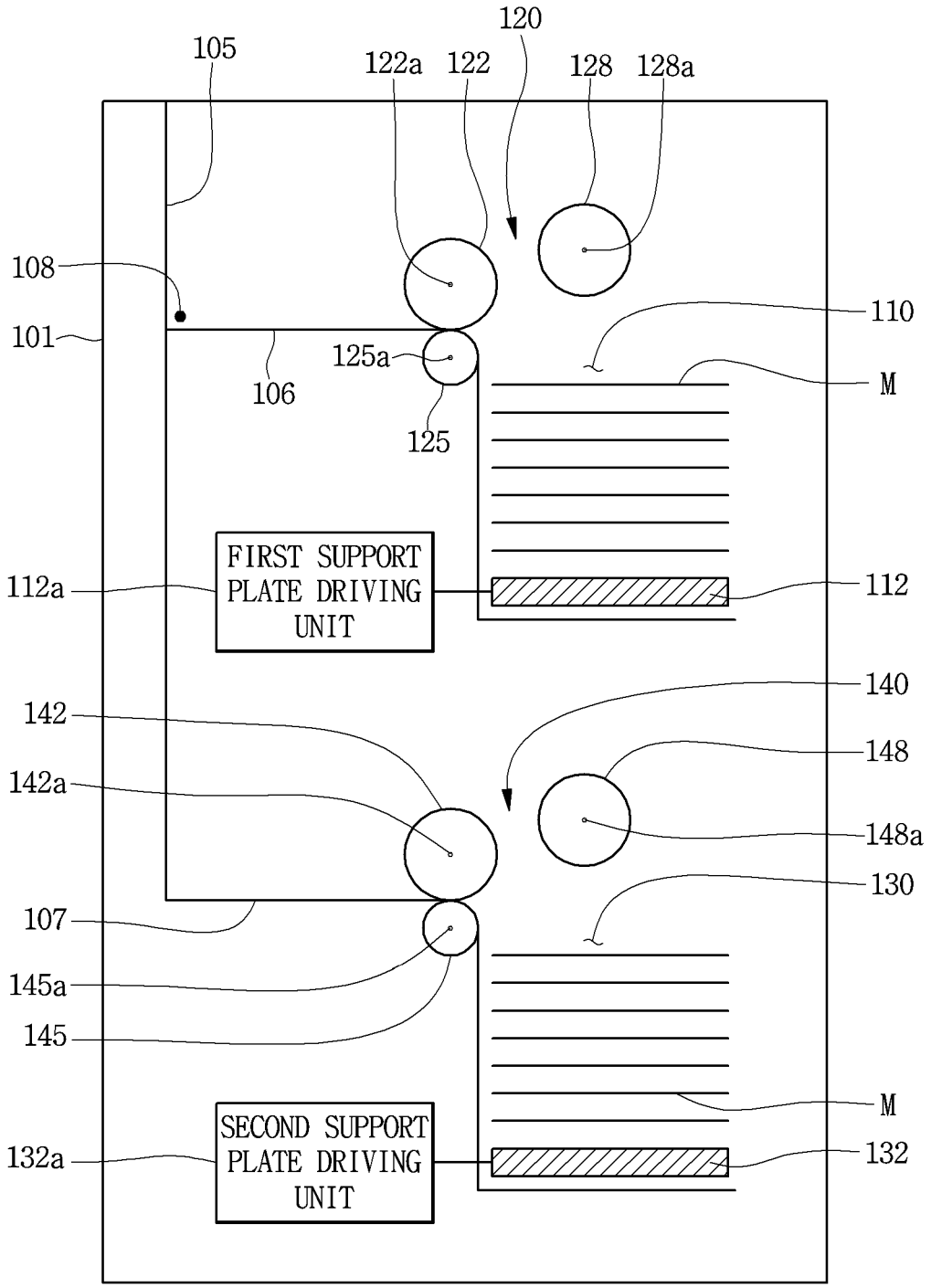
FIG. 5 is an internal cross-sectional view illustrating a medium storage box according to the embodiment of the present disclosure.
Figure 6:
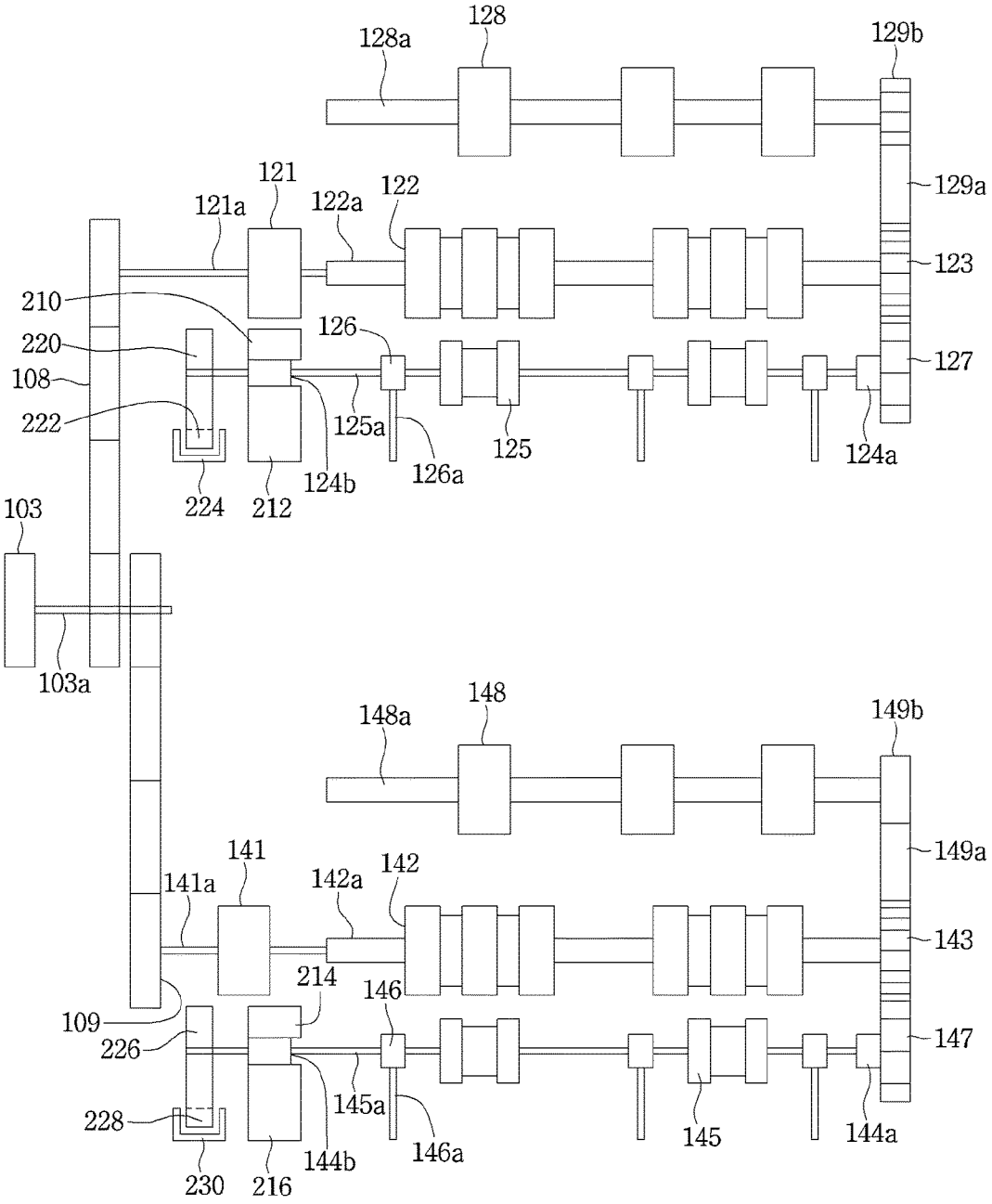
FIG. 6 is a view illustrating a power transferring mechanism of a driving unit and a medium separating and stacking device according to the embodiment of the present disclosure.

FIG. 3 is a perspective view illustrating a medium storage box according to the embodiment of the present disclosure, FIG. 4 is a perspective view illustrating the medium storage box viewed at another angle, FIG. 5 is an internal cross-sectional view illustrating a medium storage box according to the embodiment of the present disclosure, and FIG. 6 is a view illustrating a power transferring mechanism of the driving unit and the medium separating and stacking device according to the embodiment of the present disclosure.

Hereinafter, in a stat of giving a separate number to the medium storage box 100, an internal configuration will be described. The medium storage box 100 is understand as the same component as the medium storage box 40 of the financial device 1 described above. Accordingly, the medium storage box 100 may comprise the bill storage boxes 41, 42, and 43 and the check storage box 44.

With reference to FIG. 3 to FIG. 5, in the medium storage box 100 according to the embodiment of the present disclosure, a plurality of medium storage units 110 and 130 are provided in the inside of the case 101 forming an appearance. A medium which is deposited in the inside of the case 101 through the medium transferring path 105 may be stored in the plurality of medium storage units 110 and 130.

The plurality of medium storage units 110 and 130 may comprise a first storage unit 110 in which a first medium is stored and a second storage unit 130 in which a second medium is stored. The first medium and the second medium are different types of media and for example the first medium may be cash and the second medium may be check. Alternatively, the first medium and the second medium may be a different denomination of cash. Alternatively, the first medium and the second medium may be the same denomination of cash and even if being the same denomination, the first medium and the second medium may be separated and stored in the different storage units from each other depending on whether or not damaging or exchanging.

Accordingly, the medium may be stored in the corresponding storage unit by respectively being branched a first transferring path 106 and a second transferring path 107 from the medium transferring path 105 depending to the types when depositing to the inside of the medium storage box 100. To this end, a sensing unit (not illustrated) for discriminates a type of a medium may be separately provided in the medium transferring path 105.

In addition, when withdrawing a medium, a medium separated from the medium storage unit 110 and 130 may be withdrawn to the outside of the case 101 through the medium transferring path 105.

Meanwhile, medium separating and stacking devices 120 and 140 which are devices which separates a stacked medium M or transfers and stacks a medium M to the medium storage units 110 and 130 are disposed on an adjacent region to the each of the medium storage units 110 and 130.

The medium separating and stacking devices 120 and 140 include a first medium separating and stacking device 120 which is disposed to be adjacent to the first storage unit 110 and a second medium separating and stacking device 140 which is disposed to be adjacent to the second storage unit 130.

The first medium separating and stacking device 120 comprises a first pickup roller 128, a first feed roller 122 and a first gate roller 125.

The first pickup roller 128 is provided on an exit side to which a medium M is discharged form the first storage unit 110 and thus a medium M stacked to the first storage unit 110 is separated. The first feed roller 122 is coupled to a feed roller shaft 122*a* and is disposed to be adjacent to the first pickup roller 128. The first feed roller 122 transfers the medium M in the direction of the first storage unit 110 or in the opposite direction to the direction of the first storage unit 110 through the first transferring path 106. The feed roller shaft 122*a* may be installed in the case 101.

The first gate roller 125 is coupled to the gate roller shaft 125*a* installed in the case 101 and is disposed to be adjacent to the first feed roller 122 with the first transferring path 106 disposed between the first gate roller 125 and the first feed roller 122.

A first sheet roller 126 may be connected to the gate roller shaft 145. The first sheet roller 126 may comprise a plurality of sheets 126*b* which is capable of striking a medium in the stacking process of the medium.

The feed roller shaft 122*a* and the gate roller shaft 125*a* may be installed in the case 101 to be parallel to each other.

Meanwhile, the first gate roller 125 rotates in the stacking direction when stacking a medium M and stops when separating a medium and then pick up media M are separated one by one and then may be transferred.

The first pickup roller 128, the first feed roller 122 and the first gate roller 125 may be rotated by receiving power from the driving unit 103.

At this time, the first pickup roller 128 receives the rotating force of the first feed roller 122 or may be rotated by a separate power source other than the power source of the feed roller 122.

One way bearing 124*a* may be coupled to one end of the gate roller shaft 125*a*. The one way bearing means a bearing which transfers power only in one direction and does not transfer power in an opposite direction. The one way bearing may comprise a plurality of rollers which is provided an inside body, an outside body and between the inside body and the outside body.

A second gear 127 is coupled to the outer body of the one way bearing 124*a*. The gate roller shaft 125*a* is coupled to the internal body of the one way bearing 124*a*. The gate roller shaft 125*a* may rotate with an internal body of the one way bearing 124*a*. The second gear 127 is engaged with a first gear 123 connected to the feed roller shaft 122*a*.

A transferring gear 124*b* is installed to the other end of the gate roller shaft 125*a*. The transferring gear 124*b* may be fixed and installed in the gate roller shaft 122*a* so that the transferring gear 144*b* is rotated with the gate roller shaft 125*a*.

The medium storage box 100 may further comprise a first rotating control unit for controlling a rotating angle of the first sheet roller 126 so that the position of the first sheet roller 126 is capable of being fixed in a medium separating process.

The first rotating control unit may further comprise a first position detecting unit which detects a rotating angle of the first sheet roller 126 and then sends a power blocking signal to the driving unit 103.

The first position detecting unit may comprise a position detecting wheel 220 and an interrupt sensor 224.

The position detecting wheel 220 is fixed and coupled to the gate roller shaft 125*a* and a slit 222 is formed on a side thereof. At this time, the position detecting wheel 220 is fixed and coupled to the gate roller shaft 125*a* so that the first sheet roller 126 detects a position avoided at the first transferring path 106 and thus the rotation of the gate roller shaft 125*a* may be stopped by the position detecting wheel 220 being rotated with the gate roller shaft 125*a*.

The interrupt sensor 224 may comprise a light emitting unit and a light receiving unit and as an example, the position detecting wheel 220 may be disposed between the light emitting unit and the light receiving unit.

When the light emitting unit of the interrupt sensor 224 and the slit 222 is aligned in a process in which the position detecting wheel 220 is rotated, the light emitted from the light emitting unit of the interrupt sensor 224 reaches the light receiving unit of the interrupt sensor 224.

In a case where the light emitted from the light emitting unit of the interrupt sensor 224 reaches the light receiving unit of the interrupt sensor 224, a control unit (not illustrated) allows the rotation of the gate roller shaft 125*a* to be stopped.

The first rotating control unit may further comprise a first rotating prevention unit for preventing the rotation of the gate roller shaft 125*a*.

The first rotating prevention unit may comprise one way bearing 210 which is connected with the transferring gear 124*b* and a clutch 212 which is connected to the transferring gear 124*b*.

The clutch 212 may be an electronic clutch which is capable of turning on or off by control of the controller (not illustrated). At this time, in a case of turning on by the controller the rotation of the clutch 212 may be stopped and in a case of turning off by the controller the clutch 212 may be rotated since the clutch 121 is coupled to the fixing shaft.

The rotation of the transferring gear 124*b* may be stopped when the clutch 212 turns on, the transferring gear 124*b* is in a state of being rotatable when the clutch 212 turns off. At this time, the rotation of the gate roller shaft 125*a* may be also stopped when the rotation of the transferring gear 124*b* is stopped, since the transferring gear 124*b* is fixedly installed to the gate roller shaft 125*a*.

The one way bearing 210 is in an idle state with respect to the transferring gear 124*b* when the gate roller shaft 125*a* is rotated in the first direction and restricts the rotation of the transferring gear 124*b* when the gate roller shaft 125*b* is rotated in the second direction opposite to the first direction. In other words, the one way bearing 210 restricts the rotation so that the gate roller shaft 125*a* is rotated only in the first direction. Here, the controller is capable of controlling the clutch 212 so that the sheet roller is stopped in a position in which the plurality of sheets are deviated from the first transferring path 106 after completion of the stacking of the medium or before separation of the medium.

Meanwhile, a power transferring gear 129*b* is provided in the end portion of the first pickup roller shaft 128*a*. The power transferring gear 129*b* may comprise an intermediate gear 129*a* between the first gear 123 and the power transferring gear 129*b* for having the same rotating direction as that of the first feed roller 122 as a configuration for receiving power form the first gear 123.

As another example, the rotating force of the feed roller shaft 122*a* may be transferred to the first pickup roller 128 by a belt transferring mechanism.

Alternatively, the first pickup roller 128 may be configured not to be rotated by receiving the driving force from the first feed roller 122 and to be rotated by receiving power from a separate driving source.

Meanwhile, the first storage unit 110 may comprise a first supporting plate 112 in which a medium M is stacked. The first supporting plate 112 presses a medium M in the direction of the first pickup roller 128 when the medium M is separated by the first pickup roller 128.

The first supporting plate 112 may operated by receiving power from a first supporting plate driving unit 112*a*.

The second medium separating and stacking device 140 also comprises a second pickup roller 148, a second feed roller 142 and a second gate roller 145.

The second pickup roller 148 is provided on the exit side to which a medium M is discharged from the second storage unit 130 and thus a medium M stacked to the second storage unit 130 is separated. The second feed roller 142 is coupled to the feed roller shaft 142*a* and is disposed to be adjacent to the second pickup roller 148. The second pickup roller 142 transfers a medium M in the direction of the second storage unit 130 or in the opposite direction to the direction of the second storage unit through a second transferring path 107. The feed roller shaft 142*a* may be installed in the case 101.

The second gate roller 124 is coupled to the gate roller shaft 145*a* installed in the case 101 and is disposed to be adjacent to the second feed roller 142 with the second transferring path 107 disposed between the second gate roller 145 and the second feed roller 122.

A second sheet roller 146 may be connected to the gate roller shaft 145*a*. The second sheet roller 146 may comprise a plurality of sheets 146*b* which is capable of striking the medium in the stacking process of the medium.

The feed roller shaft 142*a* and the gate roller shaft 145*a* may be installed in the case 101 to be parallel to each other.

Meanwhile, the second gate roller 145 rotates in the stacking direction when stacking a medium M and stops when separating a medium and then the pickup medium M may be separated one by one and then may be transferred.

The second pickup roller 148, the second feed roller 142 and the second gate roller 145 may be rotated by receiving power from the driving unit 103.

At this time, the second pickup roller 148 receives the rotating force of the second feed roller 142 or may be rotated by a separate power source other than the power source of the second feed roller 142.

The one way bearing 144*a* may be coupled to one end of the gate roller shaft 145*a*. A fourth gear 127 is coupled to the outer body of the one way bearing 144. The gate roller shaft 145*a* is coupled to the internal body of the one way bearing 144*a*. The gate roller shaft 145*a* may rotate with an internal body of the one way bearing 144*a*. The fourth gear 147 may be engaged with the third gear 143 connected to the feed roller shaft 142*a*.

A transferring gear 144*b* is installed to the other end of the gate roller shaft 145*a*. The transferring gear 144*b* may be fixed and installed in the gate roller shaft 145*a* so that the transferring gear 144*b* is rotated with the gate roller shaft 145*a*.

The medium storage box 100 may further comprise a second rotating control unit for controlling a rotating angle of the second sheet roller 146 so that the position of the second sheet roller 146 is capable of being fixed in a medium separating process.

A second position detecting unit which detects the rotating angle of the first sheet roller 146 and then sends a power blocking signal to the driving unit 103 may further comprise in the first rotating control unit.

The second position detecting unit may comprise a position detecting wheel 226 on which a slit 228 is formed and an interrupt sensor 230.

Since a structure and an operation of the second position detecting unit is the same as those of the first position detecting unit, detailed description regarding those is omitted.

The second rotating control unit may further comprise a second rotating prevention unit for preventing the rotation of the gate roller shaft 145*a*.

The second rotating prevention unit may comprise one way bearing 214 which is connected with the transferring gear 144*b* and a clutch 216 which is connected with to the transferring gear 144*b*.

Since a structure and an operation of the second rotating prevention unit is the same as those of the first rotating prevention unit, detailed description regarding those is omitted. Meanwhile, a power transferring gear 149*b* is provided in the end portion of the second pickup roller shaft 148*a*. The power transferring gear 149*b* may comprise an intermediate gear 129*a* between the third gear 143 and the power transferring gear 149*b* for having the same rotating direction as the second feed roller 142 as a configuration for receiving power from the first gear 143.

As another example, the rotating force of the feed roller shaft 142*a* is transferred to the second pickup roller 148 by the belt transferring mechanism.

Alternatively, the second pickup roller 148 may be configured not to be rotated by receiving the driving force from the first feed roller 142 and to be rotated by receiving a driving force from a separate driving source.

Meanwhile, the second storage unit 130 may comprise a second supporting plate 132 in which the medium M is stacked. The second supporting plate 132 presses a medium M in the direction of the second pickup roller 148 when the medium M is separated by the second pickup roller 148.

The second supporting plate 132 may operated by receiving power from a second plate driving unit 132*a*.

Meanwhile, the first medium separating and stacking device 120 and the second medium separating and stacking device 140 may receive power through single driving unit 103. Specifically, the medium storage box 100 may comprise a first power clutch 121 which transfers or blocks power of the driving unit 103 to the first medium separating and stacking device 120 and a second power clutch 141 which transfers or blocks power of the driving unit 103 to the second medium separating and stacking device 140. Each of the power clutches 121 and 141 may electrically turn on/off.

Hereinafter, a power transferring mechanism of the medium storage box 100 will be described.

A rotating shaft 103*a* which is rotated according to the driving force of the driving unit 103 is connected to the driving unit 103. An end of a first power transferring portion 108 for transferring driving force of the driving unit 103 to the first power clutch 121 and an end of a second power transferring portion 109 for transferring driving force of the driving unit 103 to the second power clutch 141 are coupled to the rotating shaft 103*a*, respectively. The first power transferring portion 108 and the second power transferring portion 109 may be configured as a roller or a gear which is rotated according to rotation of the rotating shaft 103*a* in a state of being spaced apart from each other on the rotating shaft 103*a*. Alternatively, each of the power transferring units 108 and 109 may comprise a belt transferring mechanism using a belt.

Clutch shafts 121*a* and 141*a* for transferring power of the driving unit 103 to the clutches 121 and 141 are coupled to the other ends of the first power transferring portion 108 and the second power transferring portion 109. The clutch shafts 121*a* and 141*a* comprise a first clutch shaft 121*a* which is coupled with the first power clutch 121 and a second clutch shaft 141*a* which is coupled with the second power clutch 141. One ends of the clutch shafts 121*a* and 141*a* are coupled with the other ends of the power transferring portions 108 and 109 and the other ends thereof are coupled with the feed roller shafts 122*a* and 142*a*, respectively.

The first power clutch 121 and the second power clutch 141 provided to the clutch shafts 121*a* and 141*a* turn on or off and then transfer power of the driving unit 103 to the feed roller shafts 122*a* and 142*a* or block power in order not to transfer to the feed roller shafts 122*a* and 142*a*.

In other words, the driving of the first medium separating and stacking device 120 may be controlled by the first power clutch 121 and the driving of the second medium separating and stacking device 140 is may be controlled by the second power clutch 141.

As another example, the first power transferring portion 108 is capable of transferring power to the feed roller shaft 122*a* and the gate roller shaft 125*a*, respectively. At this time, the first power clutch 121 is capable of transferring power to the feed roller shaft 122*a* or blocking power from being transferred to the feed roller shaft 122*a*.

In addition, the second power transferring portion 109 is capable of transferring power to the feed roller shaft 142*a* and the gate roller shaft 145*a*, respectively. At this time, the second power clutch 141 is capable of transferring power to the feed roller shaft 142*a* or blocking power from being transferred to the feed roller shaft 142*a*.

In this case, the gate roller shafts 125*a* and 145*a* may be rotated by the operation of the driving unit 103, regardless of the operation of the each of the power clutches 108 and 109.

Hereinafter, an operating process of the medium storage box 100 will be described.

First, a medium M is deposited on the medium transferring path 105, and then the sensing unit determines whether the deposited medium M is a medium to be deposited on which storage unit in the first storage unit 110 and the second storage unit 130. In a case where a medium is determined as a medium to be deposited on the first storage unit 110 by the sensing unit, the first power clutch 121 turns on and the second power clutch 141 turns off.

When the first power clutch 121 turns on, the first medium separating and stacking device 120 is driven by power of the driving unit 103 being transferred to the first medium separating and stacking device 120.

Accordingly, a medium M is capable of being stacked on the first storage unit 110 by driving of the first gate roller 125 and the first feed roller 122 of the first medium separating and stacking device 120.

Naturally, in a case where a medium is determined as the medium M to be stored in the second storage unit 130 by the sensing unit, the first power clutch 121 turns off and the second power clutch 141 turns on and thus the second medium separating and stacking device 140 is capable of being driven.

As another example, in a case where a medium to be stored in any one of the first storage unit 110 or the second storage unit 130 is deposited on the inside of the medium storage box 110, the first power clutch 121 and the second power clutch 141 turns on, respectively. In this case, the first medium separating and stacking device 120 and the second medium separating and stacking device 140 are driven.

However, the medium M on the medium transferring path 105 is transferred to any one path of the first transferring path 106 and the second transferring path 107 by a diverter 108 and then is capable of being directly stacked on the first storage unit 120 or the second storage unit 130.

In a medium stacking process, the support plates 122 and 132 are capable of being controlled so that a space between the medium separating and stacking devices 120 and 140 and the support plates 112 and 132 (substantially the space between a medium on the uppermost side in media placed on the support plates 112 and 132 and a medium separating and stacking devices 120 and 140) has a fixed size.

Next, when a medium is withdrawn from the medium storage box 100, the medium storage box from which the corresponding medium is to be separated in the plurality of storage units 110 and 130 is selected according to the kind of a medium to be withdrawn.

For driving of the medium separating and stacking devices 120 and 140 disposed on the selected storage unit, any one clutch of the plurality of power clutch 121 and 141 turns off and thus does not transfer power and the other clutch turns on and thus power of the driving unit 103 is transferred to the medium separating and stacking device.

A fixed pressure is capable of being applied to the pickup rollers 128 and 148 by the support plates 112 and 132 corresponding to the storage unit to be withdrawn being raised when withdrawing a medium. At this time, the support plates 112 and 132 are capable of being raised after initialization by rotating the gate roller shafts 125*a* and 126*a* so that the seats 126*a* and 146 of the seat rollers 126 and 146 are not positioned to the transferring paths 106 and 107 before the raising of the support plates 112 and 132. Hereinafter, when a fixed pressure is applied to the pickup rollers 128 and 148, separation of a medium is capable of being started.

At this time, the transport unit (not illustrated) for transferring a medium on the medium transferring path 105 is capable of receiving power of the driving unit 103. Accordingly, the transport unit 103 on the medium transferring path 105 is capable of operating together with operating of the driving unit 103 regardless of on/off of the power clutch.

According to the present embodiment, when separating a medium, since the separation of the medium is performed only in the one storage unit, even if phases of the seat rollers included in the plurality of medium separating and stacking devices are different from each other, since only the phases of the seat rollers included in the medium separating and stacking devices are controlled, a medium is capable of separating from the plurality of storage units without interference of the seat rollers.

There are advantages that the number of components is reduced and manufacturing cost becomes cheaper by a plurality of medium separating and stacking devices being driven by one driving source, according to the present embodiment. In addition, component design for driving may be simplified and thus failures may be minimized by driving each medium separating and stacking device through single driving unit.

There is an advantage that Denominations which are different from each other may be deposited and withdrawn in the single storage box since the storage units in which media are capable of being stored according kinds of media are provided in the inside of the medium storage box.

The medium transferring path 105, the first transferring path 106 and the second transferring path 107 are referred to as an inner transport path and a configuration for transferring the medium in the inner transport path is referred to as an inner transport unit in the present specification. The internal transport unit may include a roller as an example. The internal transport unit is capable of transferring a medium from the medium storage box to the medium separating and stacking device.

It is described that the support plates are driven by the support plate driving units, respectively, in the embodiments above. However, in contrast, the first support plate and the second support plate are capable of being moved by the single support plate driving unit. However, in this case, the first support plate may be connected with the first clutch and the second support plate may be connected with the second clutch. Accordingly, the support plate driving unit is capable of transferring power to each support plate or is capable of blocking transfer of power to each support plate by turning on or off each clutch.

There are advantages that the number of components is reduced and manufacturing cost becomes cheaper by a plurality of medium separating and stacking devices being driven by one driving source, according to the proposed disclosure.

In addition, there is an advantage that media of the denominations which are different from each other are capable of being deposited and withdrawn in the single storage box since the storage units in which media are capable of being stored according kinds of media in the medium storage box are provided, respectively.

Even though all the elements of the embodiments are coupled into one or operated in the combined state, the present disclosure is not limited to such an embodiment. That is, all the elements may be selectively combined with each other without departing the scope of the disclosure. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the disclosure. Therefore, the preferred embodiments should be considered in descriptive sense only and not for purposes of limitation, and also the technical scope of the disclosure is not limited to the embodiments. Furthermore, is defined not by the detailed description of the disclosure but by the appended claims, and all differences within the scope will be construed as being comprised in the present disclosure.

What is claimed is:

1. A medium storage box, comprising:

a case;

a plurality of storage units which is provided in an inner space of the case;

a plurality of medium separating and stacking devices which are disposed on each of the plurality of storage units and separate stacked media or transfer and stack media to each of storage units;

an inner transport unit to transfer media to the plurality of medium separating and stacking devices in the case;

a driving unit which transfers power to the plurality of medium separating and stacking devices and the inner transport unit; and a plurality of power clutches, wherein each of the plurality of power clutches electrically turn on and turn off such that the plurality of power clutches transfer or block power of the driving unit, and wherein the plurality of power clutches turn on when depositing a medium, and wherein only the power clutch corresponding to the storage unit to be withdrawn turns on when withdrawing a medium.

2. The medium storage box of claim 1, wherein the plurality of storage units comprises a first storage unit and a second storage unit, wherein the plurality of medium separating and stacking devices comprises a first medium separating and stacking device which is provided in the first storage unit and a second medium separating and stacking device which is provided in the second storage unit, and wherein the first medium separating and stacking device and the second medium separating and stacking device are transferred power through a single driving unit.

3. The medium storage box of claim 2, wherein the plurality of power clutches comprise:

a first power clutch which is disposed between the driving unit and the first medium separating and stacking device and thus is used for transferring or blocking power of the driving unit, and a second power clutch which is disposed between the driving unit and the second medium separating and stacking device and thus is used for transferring or blocking power of the driving unit.

4. The medium storage box of claim 3, wherein the plurality of medium separating and stacking devices are driven together or are alternatively driven, by the operation of the first power clutch and the second power clutch.

5. The medium storage box of claim 1, further comprising:

a sensing unit which determines whether the medium to be deposited is a medium which is to be deposited to any storage unit of the first storage unit and the second storage unit.

6. The medium storage box of claim 5, wherein in a case where it is determined that the medium is a medium which is to be deposited to the first storage unit by the sensing unit, the first power clutch turns on and the second power clutch turns off.

7. The medium storage box of claim 6, wherein in a case where it is determined that a medium is as a medium which is to be deposited to the second storage unit by the sensing unit, the first power clutch turns off and the second power clutch turns on.

8. The medium storage box of claim 1, wherein each of the plurality of medium separating and stacking devices comprises a pickup roller which is provided in the exit side through which a medium is transferred to an outside and thus separates a medium stacked on the storage unit;

a feed roller which is disposed to be adjacent to the pickup roller and transfers a medium; and a gate roller which is disposed to be adjacent to the feed roller with a transferring path being disposed between the feed roller and the gate roller and thus rotates when a medium are stacked and stops when a medium are separated.

9. The medium storage box of claim 1, wherein the plurality of medium storages include a first storage unit in which a first media are stored and a second storage unit in which a second media are stored, and wherein the first medium and the second medium are different types of media from each other.

10. A medium storage box, comprising:

a case;

a plurality of storage units which are provided in an inner space of the case;

a plurality of medium separating and stacking devices which comprises a feed roller, a pickup roller, a gate roller and a sheet roller coaxially positioning with the gate roller, for depositing and withdrawing media to the plurality of storage units;

an inner transport path to transfer a medium to the plurality of medium separating and stacking devices in the case;

a driving unit to drive the plurality of medium separating and stacking devices;

a rotating control unit to control a rotation angle of the sheet roller; and a plurality of power clutches, wherein the rotating control unit comprises a position detecting unit to detect a portion of the sheet roller, a clutch to stop the gate roller in a position in which a plurality of sheets of the sheet roller is deviated from the inner transport path, and a controller which controls the clutch, wherein each of the plurality of power clutches electrically turn on and turn off such that the plurality of power clutches transfer or block power of the driving unit, and wherein the plurality of power clutches turn on when depositing a medium, and wherein only the power clutch corresponding to the storage unit to be withdrawn turns on when withdrawing a medium.

11. The medium storage box of claim 10, wherein the controller turns on the clutch so that the sheet roller is stopped in a case where it is detected that the plurality of sheet is moved to the position deviated from the inner transport path in the position detection unit.

12. The medium storage box of claim 10, wherein the controller controls the clutch so that the sheet roller is stopped in a position in which the plurality of sheets are deviated from the inner transport path after completion of the stacking of a medium or before separation of a medium.

13. The medium storage box of claim 12, wherein the controller turns off the clutch in a separating process of a medium.

14. A financial device, comprising:

a customer information obtaining unit that obtains customer information;

a user interface unit that displays menu and information for deposits or withdrawals and is input or selected a command or information for deposits or withdrawals; and a medium storage box which stores media for depositing or withdrawing by the customer, wherein the medium storage box comprises a case;

a plurality of storage units which is provided in an inner space of the case;

a plurality of medium separating and stacking devices which are disposed to be adjacent to each of the plurality of storage units and separate stacked media or transfer and stack a medium to the storage units;

an inner transport unit to transfer media to the plurality of medium separating and stacking devices in the case;

a driving unit which transfers power to the plurality of medium separating and stacking devices and the inner transport unit; and a plurality of power clutches, wherein each of the plurality of power clutches electrically turn on and turn off such that the plurality of power clutches transfer or block power of the driving unit, and wherein the plurality of power clutches turn on when depositing a medium, and wherein only the power clutch corresponding to the storage unit to be withdrawn turns on when withdrawing a medium.

* * * * *